United States Patent [19]

Bow

[11] 4,125,739

[45] Nov. 14, 1978

[54] CABLE SHIELDING TAPE AND CABLE

[75] Inventor: Kenneth E. Bow, Lake Jackson, Tex.

[73] Assignee: The Dow Chemical Company, Midland, Mich.

[21] Appl. No.: 746,976

[22] Filed: Dec. 2, 1976

[51] Int. Cl.[2] ..... H01B 11/06

[52] U.S. Cl. ..... 174/36; 174/107; 428/461

[58] Field of Search ..... 174/36, 102 R, 107, 174/117 R, 117 F, 115, 110 PM; 428/461, 462; 156/48-54

[56] References Cited

U.S. PATENT DOCUMENTS

| | | | |
|---|---|---|---|
| 3,575,748 | 4/1971 | Polizzano | 174/107 X |
| 3,586,756 | 6/1971 | Garner et al. | 174/36 |
| 3,622,683 | 11/1971 | Roberts et al. | 174/36 |
| 3,679,503 | 7/1972 | Dembiak et al. | 174/107 X |
| 3,681,515 | 8/1972 | Mildner | 174/107 |
| 3,826,862 | 7/1974 | Ichiba et al. | 174/107 X |
| 3,891,791 | 6/1975 | Schmidt | 174/36 X |

*Primary Examiner*—Arthur T. Grimley
*Attorney, Agent, or Firm*—T. S. Choo

[57] ABSTRACT

A cable shielding tape comprising a metal strip having a first adhesive layer of polymeric resinous material tightly adhered to at least one side thereof and a bond control layer of polymeric resinous material strippably adhered to the first adhesive layer, and plastic jacketed electrical power and communications cables utilizing such shielding tape. The outer plastic jacket of such cables withstands delamination under conditions of normal use but can easily be removed to facilitate the grounding and splicing procedures; the adhesive layer remains tightly adhered to the metal strip for protection against corrosion following the removal of the jacket.

6 Claims, 9 Drawing Figures

CABLE SHIELDING TAPE AND CABLE

BACKGROUND

I. Field of the Invention

This invention relates to a cable shielding tape comprising a metal strip having an adhesive layer of polymeric resinous material tightly adhered to at least one side thereof and a bond control layer of polymeric resinous material strippably adhered to said first adhesive layer. The invention also pertains to jacketed electrical power and communications cables utilizing such shielding tape.

II. Description of the Prior Art

In the art of designing and constructing electrical cables, especially telecommunication cables such as telephone cables, it is known to assemble insulated conductors in a core and surround it by shield and jacket components. A well known telephone cable design of such construction is referred to in the art as "Alpeth" cable. Such cable is described more fully in the F. W. Horn and R. B. Ramsey paper "Bell System Cable Sheaths Problems and Designs" in A.I.E.E. Processings 1951, Volume 70. The shielding tape of "Alpeth" cable is bare aluminum having a thickness of about 8 mils which is usually corrugated transversely prior to being wrapped about the cable core. The corrugation imparts greater flexibility to the cable and permits bending of the cable without wrinkling or rupture of the shielding tape.

The term "shield or shielding tape" as used herein means a relatively thin layer of any metal, bare or coated, which can provide mechanical protection and electrostatic and electromagnetic screening for the conductors in the core of electrical power and communications cables. The term is also referred to in the art as metallic strip, metallic foil, metallic screen, metallic barrier, metallic sheath, metallic tape, metallic foil-plastic laminate, protective sheath, shielding material, i.e. which terms are often used interchangeably.

When telephone cables are installed underground by being buried directly in soil, the outer polyethylene jacket of such cables may be subjected to damage from the rigors of installation, rocks, rodents, lightning, frost and dig-ins. The underlying shielding tapes can thereby be exposed to soil water and the attendant potential for corrosion.

In conventional plastic jacketed telephone cables, i.e., cables in which the outer jacket is a plastic material such as polyethylene, the jacket is not well adhered to the shielding tape of bare metal. The outer plastic jacket is known to slip over the shielding tape and to bunch into shoulders as the cables are pulled through ducts or plowed into trenches. Furthermore, the shielding tape is known to kink or fatigue resulting from bending stresses during installations.

In order to improve the corrosion resistance of the shielding tape of bare metal, a special adhesive polyethylene film may be applied to cover one or both sides of the metallic strip. Such an adhesive polyethylene film is disclosed in U.S. Pat. Nos. 3,233,036 and 3,795,540. The adhesive polyethylene used for this film contains reactive carboxyl groups which have the ability to develop firm adhesion to the metallic strip and also to the overlying polyethylene jacket. A metallic strip, such as aluminum, which is protected by the adhesive polyethylene is highly resistant to corrosion.

When a polyethylene jacket is extruded over the metallic strip coated with the adhesive polyethylene, the heat from the semi-molten polyethylene bonds the coated strip to the jacket, forming a unitized sheath which combines the strength of the metal component with the elongation and fatigue resistance of the polyethylene component. Such cable construction is referred to in the art as "bonded jacket" cable design. If the heat imparted to polyethylene is sufficiently high, the shielding tape would become hot enough so that the overlapped portions of the tape bond together at the seam, thereby forming a tight tube or pipe around the core of the cable. The "bonded jacket" cable with a sealed seam has significantly improved resistance to moisture penetration into the cable core. The cable construction also has been shown to have high mechanical strength necessary to withstand repeated bending of the cable, i.e. kinking and fatigue failures of the shielding tape, resulting from bending stresses during installations. Further, the stresses induced by the temperature cycles under service conditions are reduced substantially.

Although the desired bond between the outer jacket and the shielding tape of bare metal and the prevention of moisture penetration into the cable core are achieved by coating the metal with the adhesive polyethylene, some problems have been encountered in terminating and splicing the cables. More specifically, it is cumbersome to separate the jacket from the shielding tape for the purpose of making electrical connection to the tape. While it is possible to terminate and splice the "bonded jacket" cables without separating the jacket from the shielding tape, it has been shown that the quality of electrical connections is not as good as that with the jacket removed. More particularly, the electrical properties of the connections to the shielding tape are known to change less with time than the connections to the shielding tape and bonded jacket of electrical cables.

To solve the problem of terminating and splicing the "bonded jacket" cables, several approaches have been suggested. U.S. Pat. No. 3,770,570, for example, discloses a shielding tape comprising a metallic strip, such as aluminum, and an adhesive copolymer of ethylene and acrylic acid adhered to at least one side thereof. The resulting structure has zones of reduced adhesion between the metallic strip and the copolymer layer induced by a fugitive release agent or latent adhesive disposed in prescribed areas between the adhesive copolymer layer and the metallic strip. The adhesive copolymer is thereby easily removed from the designated areas to facilitate cable terminations. However, the corrosion resistance of the shielding tape in the main span of the cable, i.e., the span of the cable between two terminations, and the bond strength of the jacket to the shielding tape are sacrificed. Furthermore, the corrosion resistance of the shielding tape at the termination point is poor since the stripping of the adhesive copolymer exposes bare metal in this area.

U.S. Pat. No. 3,379,821, teaches the application of oil, talc, or other foreign substances on the outer surface of the adhesive copolymer, to reduce adhesion between the shielding tape and the jacket. However, the results are not uniform so that some parts of the jacket would be bonded to the copolymer more tenaciously than other parts and, at some locations, there would be little or no bond. Furthermore, such a practice requires an additional operating step in the manufacture of cables. U.S. Pat. No. 3,876,462 discloses a high voltage power cable having an outer semiconductive layer of tough vulcanized polyolefin which is readily strippable from the adjacent insulating layer to facilitate splicing of the cable. The strippability is imparted to the cable by sulfonating the surface of the vulcanized polyolefin layer prior to enclosing it in the semiconductive outer layer. Once again, such practice requires an additional operating step, necessitating the use of expensive equipment in the manufacture of cables.

U.S. Pat. No. 3,424,631 describes yet another approach; namely, a method of preparing cables having a shielding tape of bare metal with a controlled jacket strippability. This method comprises placing circumferentially or longitudinally onto the shielding tape a covering of a film of a copolymer of ethylene and a polar monomer, and applying a polyolefin outer jacket to the ethylene copolymer whereby the polyolefin outer jacket firmly adheres to but is strippable from the shielding tape. The degree of adhesion or strippability of the polyolefin outer jacket to the shielding tape is controlled through variations in the polar comonomer content and/or melt index of the copolymer film. A similar approach is also used in U.S. Pat. No. 3,891,791, which uses various blends of an adhesive copolymer with polyethylene homopolymer. With both of the approaches described above, the adhesive film is separated from the shielding tape at the metal and film interface, leaving the metal unprotected from corrosion after stripping.

U.S. Pat. No. 3,950,605 discloses a shielding tape comprising a metallic strip, such as aluminum, and an upper layer of ethylene and vinyl acetate copolymer containing 3 to 8 weight percent of vinyl acetate and a lower layer of an ethylene and vinyl acetate copolymer containing 10 to 45 weight percent of vinyl acetate. The lower layer is thermally pressed in contact with the metallic strip and the upper layer is capable of being adhered to an outer polyethylene jacket when the jacket is extruded over the shielding tape during the manufacture of the cable. The lower layer has excellent adhesion to the metallic strip, but poor adhesion to polyethylene; on the other hand, the upper layer has excellent adhesion to polyethylene, but poor adhesion to the metallic strip. Hence, the patent teaches the use of composite plastic film to obtain "perfect adhesion" between the metallic strip and the polyethylene jacket. The adhesion between the two layers of composite plastic film is effected by thermal welding; therefore, it is difficult to peel off and separate them. Furthermore, when the jacket is stripped from the cable made with the shielding tape of this patent, a separation will occur as the metal and the lower layer interface, leaving the metal unprotected from corrosion after stripping.

For an optimum control of jacket strippability and greater reduction in bond strength between the jacket and the shielding tape, it may be necessary to combine the above approaches of controlling bond strength with reduced melt temperatures of jacket extrudate. Sometimes lowering the jacketing temperature, by itself, may suffice as a bond control method since bonding of the coating of the shielding tape and jacket is a function of time and temperature. Higher bond strengths usually result when an interface to be bonded is subjected to increasing temperatures and longer time periods above the melting point of the respective materials to be bonded. Therefore, use of lower melt temperatures to achieve strippability is inconsistent with the extrusion conditions needed for high quality jacket and the optimum mechanical reinforcement through bonding of the shielding tape and the jacket.

Accordingly, it is an object of this invention to provide a shielding tape to which an outer jacket may be firmly bonded thereto wherein the jacket may be removed to facilitate the splicing and grounded procedures. Another object of this invention is to provide corrosion protection in all areas of such shielding tape by allowing removal of the jacket in such a manner that a tightly adhered plastic coating remains on the metal component of the tape after stripping of the jacket. Yet another object of this invention is to control the level of the bond between the jacket and the shielding tape without introducing any foreign substances therebetween which are known to contribute to the degradation of either the plastic coating or the jacket or to instability of the shield/jacket bond. It is a further object of this invention to reduce the cost of cable manufacture by eliminating the need for special equipment or additional processing steps for the purpose of controlling the level of adhesion between the jacket and the shielding tape. A yet further object of this invention is to allow the cable maker a greater degree of freedom in choosing the extrusion conditions needed for high quality jacket and the optimum mechanical reinforcement of the cable through bonding of the shielding tape and the jacket. Other objects and advantages of the invention will become apparent in the following description.

SUMMARY OF THE INVENTION

The objects of this invention are attained by a cable shielding tape which comprises a metal strip having in combination therewith a separable multilayered coating wherein the interlayer adhesion of such coating is governed by the use of a bond control layer. More specifically, the shielding tape comprises a metal strip having a first adhesive layer tightly adhered to at least one side thereof and a bond control layer strippably adhered to the first adhesive layer. In addition, a second adhesive layer maybe strippably adhered to the non-coated surface of the bond control layer. adhered By judicious selection of the types and proportions of the polymer composition for the bond control layer, the adhesion of the bond control layer to the adjacent adhesive layer is made lower than that of the first adhesive layer to the metallic strip or the second adhesive layer to the jacket. When the jacket is stripped from the cable, a separation in the multilayered coating structure in the shielding tape occurs either at the jacket/bond control layer interface or the bond control layer/outer adhesive layer interface. In each instance, at least the inner adhesive layer remains tightly adered to the metal strip to provide corrosion protection.

As herein defined, the term "tightly adhered" means a chemical and/or mechanical bond which is capable of withstanding delamination under conditions of normal use as well as stripping of the bond control layer.

As herein defined, the term "strippably adhered" means a chemical and/or mechanical bond which is capable of withstanding delamination under conditions of normal use but which will separate prior to delamination of the tightly adhered layers.

BRIEF DESCRIPTION OF THE DRAWINGS

The invention is further illustrated by reference to the accompanying drawings in which like characters of reference designate corresponding materials and the parts through the seveal views thereof, in which.

DETAILED DESCRIPTION AND EMBODIMENTS

Figure 1:
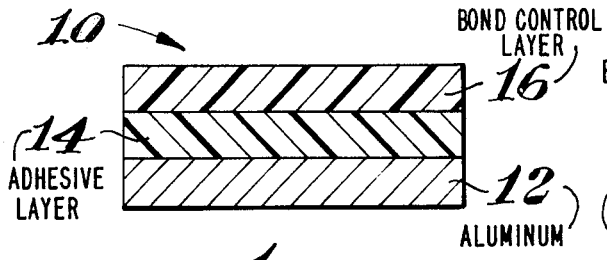
FIGS. 1 and 2 are partial cross-sectional views of plastic coated metal shielding tape constructed according to the principals of the present invention.

The following description also illustrates the manner in which the principles of the invention are applied but is not to be construed as limiting the scope of the invention.

More specifically, as herein defined, the metal strip means a relatively thin layer of any metal which has good electrical or mechanical properties useful in electrical power and communications cables. The metal strip may have a thickness from about 0.2 mil to about 25 mils and, more preferably, from about 2 mils to about 15 mils. The metal strip may be formed from aluminum, aluminum alloys, alloy-clad aluminum, copper, bronze, steel, tin free steel, tin plate steel, aluminized steel, stainless steel, copper-clad stainless steel, terneplate steel, galvanized steel, chrome or chrome treated steel, lead, magnesium, tin or the like.

The bond control layer which is used in accordance with this invention may have a thickness from about 0.1 mil to about 15 mils and, more preferably, from about 0.5 mil to about 2.0 mils. This layer may be formed from any normally solid polymeric resinous material that will strippably adhere to an adhesive layer or the plastic jacket of an electrical cable. More specifically, the bond control layer may be formed from any polymeric resinous material which will provide an interlayer adhesion of the bond control layer to the adhesive layer or the jacket which is less than the interlayer adhesion of the first adhesive layer to the metallic strip or the second adhesive layer to the jacket. For an electrical cable utilizing the shielding tape of this invention such adhesion represents a value of from about 2 pounds per inch to about 20 pounds per inch, preferably from about 5 pounds per inch to about 17.5 pounds per inch. Materials which can be used to form the bond control layer include polypropylene, carboxyl modified polypropylene, polyamides, polyethylene terephthalate, fluoro polymers, 1–4,di-methylpentene polymers, ethylene/-propylene copolymers, and stereoregular polystyrene. Such resinous materials may be blended with low or high density polyethylene, ethylene/ethylacrylate copolymers, ethylene/vinylacetate copolymers, carboxyl modified ethylene polymers, ethylene/acrylic acid copolymers, ionic olefin polymers and chlorinated polyethylene provided that the interlayer adhesion between the bond control layer and the adjacent adhesive layer is in the range of those values stated hereinbefore. Flexible thermoset polymeric resinous material, such as polyurethanes, may also be used provided they strippably adhere to the adhesive layer or the plastic jacket.

The adhesive layer, as herein defined, means a layer of polymeric resinous material having good bonding characteristics with the metal strip, the bond control layer and the plastic jacket of an electrical cable. The adhesive layer may have a thickness from about 0.1 mil to 10 mils, preferably from about 0.3 mil to about 2.5 mils. Such layer may be formed from any known thermoplastic polymeric resinous material which will tightly adhere to the metal strip and the jacket and will strippably adhere to the bond control layer. However, an ethylene copolymer with ethylenically unsaturated carboxylic acid which readily forms a strong adhesive bond with aluminum is preferred. Copolymers of ethylene and ethylenically unsaturated carboxylic acids useful in achieving the present invention are described in U.S. Pat. No. 3,795,540, which patent is herein fully incorporated by reference thereto. More specifically, the adhesive polymer which is beneficially used in accordance with this invention is a normally solid thermoplastic polymer of ethylene modified by monomers having reactive carboxylic acid groups, particularly a copolymer of a major proportion of ethylene and a minor proportion, typically from about 1 to about 30, preferably from about 2 to about 20, percent by weight, of an ethylenically unsaturated carboxylic acid. Specific examples of suitable such ethylenically unsaturated carboxylic acids (which term includes mono- and polybasic acids, acid anhydrides, and partial esters of polybasic acids) are acrylic acid, methacrylic acid, crotonic acid, fumaric acid, maleic acid, itaconic acid, maleic anhydride, monomethyl maleate, monoethyl maleate, monomethyl fumarate, monoethyl fumarate, tripropylene glycol monomethyl ether acid maleate, ethylene glycol monophenyl ether acid maleate, etc. The carboxylic acid monomer is preferably selected from $\alpha,\beta$-ethylenically unsaturated mono- and polycarboxylic acids and acid anhydrides having from 3 to 8 carbon atoms per molecule and partial esters of such polycarboxylic acid wherein the acid moiety has at least one carboxylic acid group and the alcohol moiety has from 1 to 20 carbon atoms. The copolymer may consist essentially of ethylene and one or more of such ethylenically unsaturated acid comonomers or can also contain small amounts of other monomers copolymerizable with ethylene. Thus, the copolymer can contain other copolymerizable monomers including an ester of acrylic acid. The comonomers can be combined in the copolymer in any way, e.g., as random copolymers, as block or sequential copolymers, or as graft copolymers. Materials of these kinds and methods of making them are readily known in the art.

Referring to the drawings, FIG. 1 illustrates an improved cable shielding tape 10 comprising an aluminum layer 12 having a first adhesive layer 14 formed of an ethylene/acrylic acid copolymer tightly adhered to one side thereof and a bond control layer 16 formed of a polymeric resinous material such as a blend of 50 weight percent polypropylene and 50 weight percent ethylene/acrylic acid polymer strippably adhered to layer 14.

Figure 2:
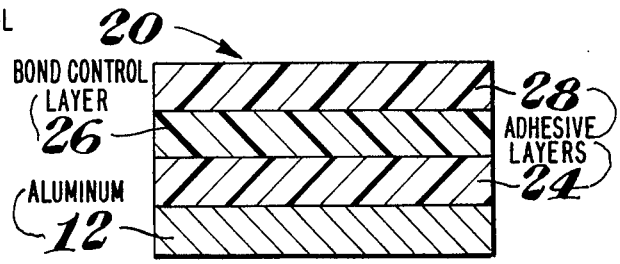

FIG. 2 illustrates an improved cable shielding tape 20 comprising an aluminum layer 12 having a first adhesive layer 24 like layer 14 of FIG. 1 tightly adhered to one side thereof, a bond control layer 26 like layer 16 of FIG. 1 strippably adhered to layer 24 and a second adhesive layer 28 formed of an ethylene/acrylic acid copolymer strippably adhered to layer 26.

Figure 3:
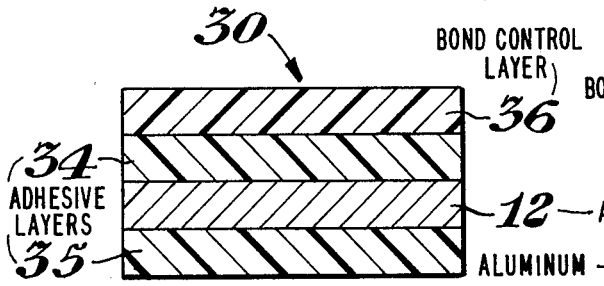
FIGS. 3–7 are partial cross-sectional views illustrating modified plastic coated metal shielding tapes constructed according to the principals of the present invention.

FIG. 3 illustrates a modified cable shielding tape 30. The aluminum layer 12 has adhesive layers 34 and 35 formed of an ethylene/acrylic acid copolymer tightly adhered to both sides thereof and a bond control layer 36 like layer 16 of FIG. 1 strippably adhered to layer 34.

Figure 4:
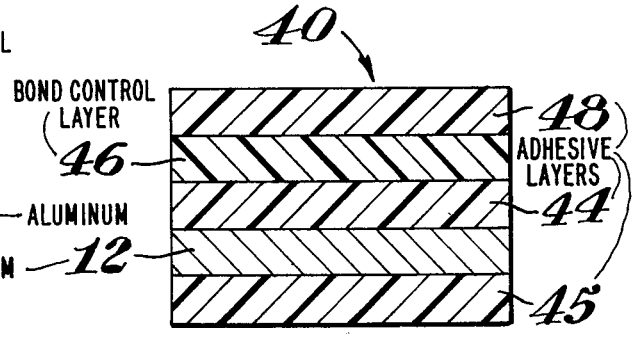

FIG. 4 illustrates another modified cable shielding tape 40. The aluminum 12 has adhesive layers 44 and 45 like layer 14 of FIG. 1 tightly adhered to both sides thereof, a bond control layer 46 like layer 16 of FIG. 1 strippably adhered to layer 44 and another adhesive layer 48 like layer 28 of FIG. 2 strippably adhered to layer 46.

Figure 5:
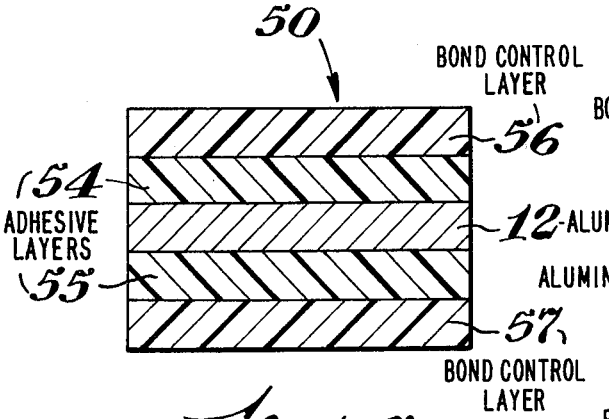

FIG. 5 illustrates still another modified cable shielding tape 50. The aluminum layer 12 has adhesive layers 54 and 55 which are the same as the corresponding layers 34 and 35 in FIG. 3 tightly adhered to both sides thereof and bond control layers 56 and 57 like layer 16 of FIG. 1 strippably adhered to the adhesive layers 54 and 55, respectively.

Figure 6:
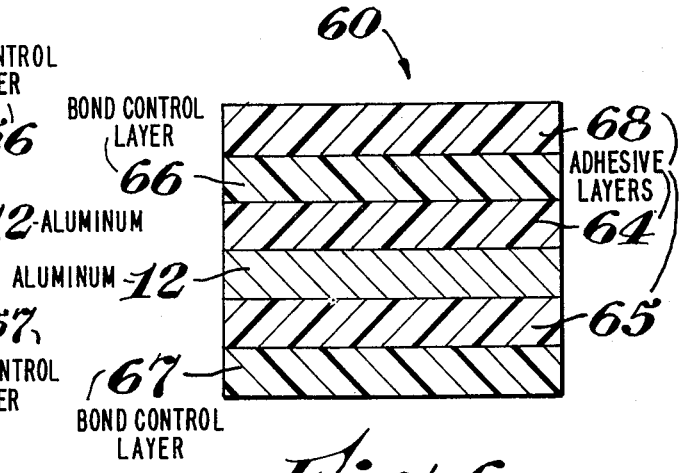

FIG. 6 illustrates still another modified cable shielding tape 60. The first adhesive layer 64, bond control layer 66 and the second adhesive layer 68 are the same as the corresponding layers 44, 46, and 48 found in FIG. 4. The adhesive layer 65 and bond control layer 67, located on the opposite side of aluminum layer 12, are the same as the corresponding layers 55 and 56 found in FIG. 5.

Figure 7:
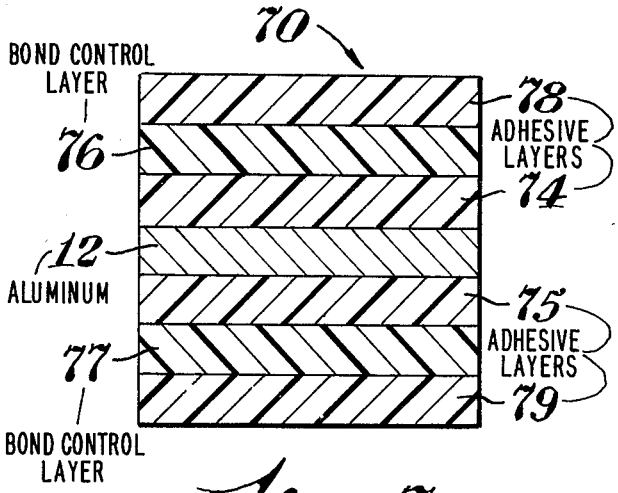

FIG. 7 illustrates a modified cable shielding tape 70. The first adhesive layers 74 and 75, bond control layers 76 and 77, and the second adhesive layers 78 and 79 are the same as the corresponding layers 44, 46 and 48 found in FIG. 4.

Figure 8:
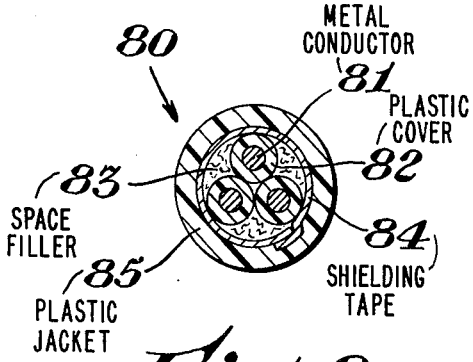
FIG. 8 is a cross-sectional view of a typical power cable with three insulated conductors, a plastic coated metal shield and an outer plastic jacket.
Figure 9:
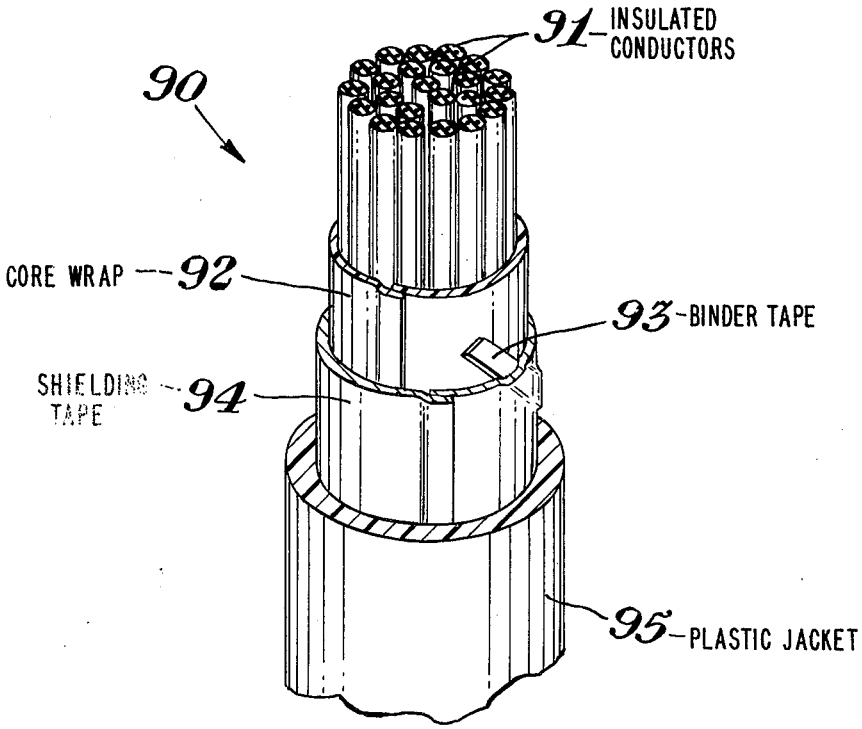
FIG. 9 is a cut-away perspective view of an end of a communication cable with multi-pair insulated conductors in the core, plastic coated metal shield and a plastic outer jacket.

Referring now to FIGS. 8 and 9, a typical three-conductor power cable 80 and multi-pair conductor communication cable 90 are illustrated. The power cable 80 has low resistance metal conductors 81, which can be solid or stranded, usually of copper or aluminum, which are each insulated, usually with an extruded plastic cover 82 of polyvinyl chloride, polyethylene or rubber. Space fillers 83 of natural fibers or foamed plastic are used to provide a substantially circular core assembly which is enclosed in a shielding tape 84 formed from any one of the shielding tape structures illustrated in FIGS. 1–7. The shielding tape 84 is preferably a longitudinally folded tube with an overlapping seam that may be hermetically sealed by heat sealing the plastic coating of the shielding tape together in the overlapping seam during cable manufacture. An outer plastic jacket 85, usually extruded polyethylene containing stabilizers of carbon black, is beneficially bonded to the shielding tape 84. The communications cable 90 includes an inner core of a plurality of pairs of insulated conductors 91 (e.g. plastic coated copper wires) bundled in a plastic core wrap 92 of polypropylene or polyethylene terephthalate which is securely bound with a binder tape 93. The binder is enclosed in a shielding tape 94 formed from any one of the shielding tape structures illustrated in FIGS. 1–7. Like the shielding tape 84 of power cable 80, shielding tape 94 is preferably a longitudinally folded tube with a hermetically sealed overlapping seam. An outer plastic jacket 95 preferably of polyethylene is extruded over the shield 94 and is advantageously bonded to the same.

Representative examples of the present invention along with adhesive strengths of shielding tape to jacket and the location of layer separation are illustrated in the following Table I. Results of corrosion resistance tests on shielding tapes before fabrication into the cable and on the shielding tapes stripped from controlled bond cables are illustrated in Table II. The effect of aging at 70° C water on the adhesive strengths of shielding tape to jacket are illustrated in Table III. Blends of polymeric resinous materials used in the Examples of Table I were prepared by dry blending of granules, dry blending of granules plus one pass through a compounding extruder, dry blending of powders, dry blending of powders and granules. Any method which can be conveniently used to mix and to blend polymeric resinous materials may also be used. Multilayered films containing these blends were prepared on suitable equipment by application of the well known coextrusion art. The multilayered films were about 1.7 to 3.0 mils in thickness and individual layers varied from about 0.5 to about 2.3 mils. The resultant multilayer films were then laminated to a hot aluminum strip having a temperature of about 375° F using a laminator.

Adhesive strengths of the shielding tape to the jacket were determined according to the following test procedure: a six inch wide by six inch long by sixty mil thick molding of a plastic jacketing material was prepared using a procedure similar to that described in Rural Electricification Administration (REA) Specification PE-200. A sheet of shielding tape of the same dimensions was placed over the molding. A polyester film of 1 mil thickness was placed between the coated shielding tape and the molding of the jacketing material to prevent bonding to one end and thus form a "tab" for use in a tensile testing machine. The shielding tape was bonded to the molding using a compression molding press and a molding temperature of 190° C. The molding pressure was 300 pounds per square inch. The heating cycle was as follows: 3 minutes to reach temperature with no pressure, 2 minutes under pressure, and 5 minutes to cool to room temperature. After the shielding tape/jacketing material laminate was prepared, one inch wide samples for bond tests were cut on a sample cutter. The samples were placed on a tensile testing machine and tested for bond strength as follows: the unbonded portion of the shielding tape was folded back 180°; the sample was inserted into the tensile testing machine with the shielding tape in the upper jaw and the molding of jacketing material in the lower jaw; a rigid metal plate was placed behind the molding to maintain the peeling angle at 180°; and the coated shielding tape was then separated from the rigid molding at a crosshead speed of 5 inches per minute. The required force to separate the shielding tape from the molding was recorded as a measure of adhesive strength.

For select examples in Table I indicated with asterisks (*), adhesive strengths of the shielding tape to the jacket were determined according to the following procedure: the shielding tape shown in FIG. 4 was made by laminating various polymeric films to 12 inch wide rolls of 8 mil thick, 1145 alloy aluminum sheet, the resulting laminate was slit into a 2⅝" wide shielding tape suitable for use on a cable jacketing line; the shielding tape was folded longitudinally into a tubular structure with slightly overlapping edges using a former, such that the bond control layer and the adjacent unbonded adhesive layer were disposed to the outside of the structure. Cable cores were not used in these examples. A polyethylene jacket was extruded over the shielding tape at a line speed of 16 feet per minute and a melt temperature of 418° F; the jacket was cooled in a trough containing water at a temperature of about 70° F and had an average thickness of about 61 mils; a six-inch long section was cut circumferentially from the resulting bonded jacket tubular structure, slit longitudinally, and "flattened" into a sheet form; and three ½ inch strips were cut using a sample cutter for use in a tensile testing machine. The strips were placed on the machine and tested for adhesive strengths of the shielding tape to jacket according to the procedure described above.

From the results and the data shown in Table I, it will be seen that the adhesion between the shielding tape and the jacket in a cable of this invention depends on the composition of the bond control layer. For polypropylene blends of Examples 1–10, adhesive strengths depend on the type and proportions of the polymeric material in the blends. The bond control layer of Example 6 formed of a blend of 50 weight percent polypropylene and a 50 percent low density polyethylene had adhesive strength of 4.9 pounds per inch of sample width whereas the bond control layer of Example 7 formed of a blend of 50 weight percent polypropylene and 50 weight percent ethylene/acrylic acid copolymer had adhesive strength of 13.5 pounds per inch of sample width. Thus, by judicious selection of the composition of the bond control layer a range of interlayer adhesion levels can be obtained to impart varying degrees of strippability into the cable.

Corrosion resistance index of shielding tape was determined according to the following procedure: a two inch square sample of shielding tape was placed in aqueous solution of 1 normal sodium hydroxide for 24 hours. Percent of original weight remaining after the test is expressed as corrosion resistance index for a given sample.

From the results and the data shown in Table II it will be seen that shielding tapes from the prior art references (Examples 8–10) have no corrosion resistance when tested after being stripped from the cable.

Table III illustrates that the adhesion between the bond control layer and the jacket in a cable of this invention is not adversely affected when such cable is immersed in water. This data was obtained by placing the samples of Table I in 70° C water and aging for a predetermined length of time, removing from the water, allowing to cool to room temperature, waiting for at least 24 hours, and then pulling on the tensile testing machine to determine adhesive strength. It will be seen that a cable sample prepared in accordance with the method disclosed in U.S. Pat. No. 3,379,821, (Example 10) shows a high degree of water sensitivity of the adhesion between the jacket and the shielding tape when talc is used as a releasing agent to control the jacket strippability.

"Melt Index" was determined ty ASTM D-1238 at 190° C and "melt Flow Index" was determined by ASTM D-1238 at 230° C.

TABLE I

Adhesive Strength of Shielding Tape to Jacket

| Example | Layer Construction[1] | Adhesive Strength (lb/in of Width) | Interface of Layer Separation |
|---|---|---|---|
| 1 | EAA/Al/EAA/70% LDPE[1]-30% PP[1]/EAA/J | 11.0 | First EAA/B.C.L. |
| 2 | EAA/Al/EAA/90% LDPE[2]-10% PP[1]/J | 15.5 | " |
| 3 | EAA/Al/EAA/80% LDPE[2]-20% PP[1]/J | 11.2 | " |
| 4 | EAA/Al/EAA/70% LDPE[2]-30% PP[1]/J | 10.9 | " |
| 5 | EAA/Al/EAA/60%LDPE[2]-40% PP[1]/J | 7.9 | " |
| 6 | EAA/Al/EAA/50% LDPE[2]-50% PP[1]/J | 4.9 | " |
| 7 | EAA/Al/EAA/50% EAA-50% PP[1]/J | 13.5 | " |
| 8 | EAA/Al/EAA/80% HDPE[1]-20% PP[1]/J | 9.3 | B.C.L./J |
| 9* | EAA/Al/EAA/50% EAA-50% PP[1]/EAA/J | 11.0 | First EAA/B.C.L. |
| 10* | EAA/Al/EAA/40% HDPE[3]-60% PP[1]/EAA/J | 7.8 | " |
| 11* | EAA/Al/EAA/100% Nylon/EAA/J | 17.1 | " |
| #12 | EAA/Al/EAA/J | 17.0 | Al/EAA |
| #13 | EAA/Al/EAA/(Talc)/J | 4.3 | EAA/Jacket |
| #14 | EAA/Al/EAA(silicone oil)/J | 17.5 | Al/EAA |
| #15 | 60% HDPE[2]-40% EAA/Al/60% HDPE[2]-40% EAA/J | 2.6 | " |
| 16 | EAA/TPS/EAA/40% HDPE[3]-60% PP[2]/EAA/J | 12.6 | B.C.L./Second EAA |
| 17 | EAA/TPS/EAA/45% HDPE[3]-55% PP[2]/EAA/J | 14.0 | " |
| 18 | EAA/TPS/EAA/80% LDPE[1]-20% PP[1]/J | 15.0 | First EAA/B.C.L. |
| #19 | EAA/TPS/EAA/J | 38.7 | TPS/EAA |

Notes:
[1]-All blend percentages on a weight basis
Al-Electrical grade aluminum layer, 8 mils thick
EAA-Ethylene/Acrylic Acid copolymer layer, 8% by weight Acrylic Acid
PP-Polypropylene layer, Melt Flow Index 7.0, Density 0.908
LDPE[1]-Low density polyethylene, Melt Index 13.5, Density 09.915
LDPE[2]-Low density polyethylene, Melt Index 5.5, Density 0.916
HDPE[1]-High density polyethylene, Melt Index 8.0, Density 0.950
HDPE[2]-High density polyethylene, Melt INdex 30.0, Density 0.0960
HDPE[3]-High density polyethylene, Melt Index 5.0, Density 0.964
J-Black polyethylene outer jacket layer
Nylon-Nylon 6
TPS-Tin plate steel layer, 6 mils thick
#-Not examples of this invention

TABLE II

Corrosion Resistance Index of Shielding Tape

| Example | Layer Construction | Before Cable Manufacture | After Jacket Stripping |
|---|---|---|---|
| 1 | EAA/Al/EAA/70% LDPE[1]-30% PP[1]/EAA/J | 77.5 | 78.2 |
| 2 | EAA/Al/EAA/90% LDPE[2]-10% PP[1]/J | " | 76.8 |
| 3 | EAA/Al/EAA/80% LDPE[2]-20% PP[1]/J | " | 79.8 |
| 4 | EAA/Al/EAA/70% LDPE[2]-30% PP[1]/J | " | 85.3 |
| 5 | EAA/Al/EAA/60% LDPE[2]-40% PP[1]/J | " | 82.2 |
| 6 | EAA/Al/EAA/50% LDPE[2]-50% PP[1]/J | " | 83.2 |
| 7 | EAA/Al/EAA/50% EAA-50% PP[1]/J | 76.4 | 79.0 |
| #8 | EAA/Al/EAA/J | 77.0 | 0 |
| #9 | EAA/Al/EAA(Silicone oil)/J | 80.0 | 0 |

TABLE II-continued

| Example | Layer Construction | Corrosion Resistance Index of Shielding Tape: Before Cable Manufacture | After Jacket Stripping |
|---|---|---|---|
| #10 | 60% HDPE[2]-40% EAA/Al/60% HDPE[2]-40% EAA/J | 66.0 | 0 |

Notes:
As in Table I

TABLE III

Effect of Aging in 70° C Water on Adhesive Strength

| Example | Layer Construction | Adhesive Strength (lb/in of width): Initial | Aged (4 days) |
|---|---|---|---|
| 1 | EAA/Al/EAA/70% LDPE[1]-30% PP[1]/EAA/J | 11.0 | 10.9 |
| 2 | EAA/Al/EAA/90% LDPE[2]-10% PP[1]/J | 15.5 | 13.9 |
| 3 | EAA/Al/EAA/80% LDPE[2]-20% PP[1]/J | 11.2 | 10.4 |
| 4 | EAA/Al/EAA/70% LDPE[2]-30% PP[1]/J | 10.9 | 10.0 |
| 5 | EAA/Al/EAA/60% LDPE[2]-40% PP[1]/J | 7.9 | 8.0 |
| 6 | EAA/Al/EAA/50% LDPE[2]-50% PP[1]/J | 4.9 | 4.9 |
| 7 | EAA/Al/EAA/50% EAA-50% PP[1]/J | 13.5 | 13.4 |
| 8 | EAA/Al/EAA/80% HDPE[1]-20% PP[1]/J | 9.3 | 8.7 |
| #9 | EAA/Al/EAA/J | 17.0 | 22.0 |
| #10 | EAA/Al/EAA/(Talc)/J | 4.3 | 2.0 |
| #11 | EAA/Al/EAA/(Silicone oil)/J | 17.5 | 17.9 |
| #12 | 60% HDPE[2]-40% EAA/Al/60% HDPE[2]-40% EAA/J | 2.6 | 3.5 |

Notes:
As in Table I

While certain representative embodiments have been shown in detail for the purposes of illustrating the invention, it will be apparent to those skilled in the art that various changes and modifications can be made without departing from the spirit and scope of the invention.

What is claimed is:

1. A corrosion resistant cable shielding tape adapted for use in an electrical power or communications cable, said cable comprising a core of at least one insulated conductor, a shield surrounding the core and an outer plastic jacket surrounding and bonded to the shield, said shield comprising:

(1) metal strip having adhered to at least one side thereof a first adhesive layer composed of a copolymer of ethylene and from about 2 to about 20 percent based on copolymer weight of an ethylenically unsaturated carboxylic acid, the adhesive bond between said metal strip and said first adhesive layer being at least 2 pounds per inch of shielding tape width and sufficient to withstand delamination under conditions of normal use; and (2) a bond control layer composed of a polymeric resinous material strippably adhered to said first adhesive layer, the adhesive bond between said first adhesive layer and said bond control layer being from about 2to about 20 pounds per one inch of shielding tape width and sufficient to withstand delamination under conditions of normal use but being less than the adhesive bond between said first adhesive layer and said metal strip, whereby, when the jacket is stripped from the cable, said bond control layer separates from said first adhesive layer prior to declamination of said first adhesive layer from said metal strip, leaving said first adhesive layer tightly adhered to said metal strip to provide corrosion protection thereto.

2. The cable shielding tape of claim 1 wherein said metal strip is selected from the group consisting of aluminum, copper, bronze, tin-free steel, tin-plate steel and copper-clad stainless steel.

3. The cable shielding tape of claim 1 wherein said copolymer is a random copolymer of ethylene and acrylic acid.

4. The cable shielding tape of claim 1 wherein said bond control layer comprises a blend of about 10 to 60 percent by weight of polypropylene and about 50 to about 90 percent by weight of polyethylene.

5. The cable shielding tape of claim 1 wherein a second adhesive layer of a copolymer of ethylene and from about 2 to about 20 percent by copolymer weight of an ethylenically unsaturated carboxylic acid is strippably adhered to the opposed surface of said bond control layer.

6. A cable adapted for use in supplying electrical power and communications comprising a core of at least one insulated conductor and a shield surrounding the core, said shield comprising a metal strip having a first adhesive layer composed of a copolymer of ethylene and from about 2 to about 20 percent based on copolymer weight of an ethylenically unsaturated carboxylic acid tightly adhered to the outwardly facing surface of said metal strip, a bond control layer of polymeric resinous material strippably adhered to said first adhesive layer, the adhesive bond between said first adhesive layer and said bond control layer being about 2 to about 20 pounds per inch of shielding tape width, and an outer plastic jacket surrounding and bonded to said shield.

* * * * *